United States Patent [19]

Izumiyama et al.

[11] 4,127,428

[45] Nov. 28, 1978

[54] STAINLESS CAST ALLOY STEEL FOR USE AT LOW TEMPERATURES

[75] Inventors: Masao Izumiyama, Zushi; Naohiko Kagawa; Kenji Satoh, both of Yokohama, all of Japan

[73] Assignee: Japan Gasoline Co., Ltd., Tokyo, Japan

[21] Appl. No.: 710,818

[22] Filed: Aug. 2, 1976

[30] Foreign Application Priority Data

Aug. 2, 1975 [JP] Japan ..... 50-94299

[51] Int. Cl.[2] ..... C22C 38/40

[52] U.S. Cl. ..... 148/38; 75/128 A; 75/128 C; 75/128 R; 148/37

[58] Field of Search ..... 75/128 R, 128 A, 128 C; 148/37, 38

[56] References Cited

U.S. PATENT DOCUMENTS

| | | | |
|---|---|---|---|
| 3,337,331 | 8/1967 | Ljungberg | 75/128 C |
| 3,523,788 | 8/1970 | Bates et al. | 75/128 N |
| 3,567,434 | 3/1971 | Richardson et al. | 75/128 C |
| 3,620,690 | 11/1971 | Bergstrom | 148/38 |
| 3,650,709 | 3/1972 | Morsing | 75/128 R |
| 3,717,455 | 2/1973 | Hede et al. | 75/128 N |
| 3,994,392 | 11/1976 | Kajiyama et al. | 75/128 R |
| 4,002,510 | 1/1977 | Wilde | 148/38 |
| 4,055,448 | 10/1977 | Fujikura et al. | 148/38 |

OTHER PUBLICATIONS

Metals Handbook, vol. 1, 8th Ed., ASM, 1961, pp. 432, 436, 440, 441, 442.

*Primary Examiner*—Arthur J. Steiner
*Attorney, Agent, or Firm*—Sughrue, Rothwell, Mion, Zinn and Macpeak

[57] ABSTRACT

A stainless cast alloy steel suitable for ground joint portions, airtight portions, sliding portions, etc., used at low temperatures comprising: from about 0.03 to about 0.15% by weight of C; up to about 2% by weight of Si; up to about 2% by weight of Mn; from about 18 to about 26% by weight of Cr; from about 5 to about 13% by weight of Ni, the remainder being Fe and unavoidable trace impurities; wherein a ferrite phase is present in an amount of from about 10 to about 40% by volume, based on the volume of the stainless cast alloy steel.

4 Claims, 3 Drawing Figures

X 480

X 100

STAINLESS CAST ALLOY STEEL FOR USE AT LOW TEMPERATURES

BACKGROUND OF THE INVENTION

1. Field of the Invention

The present invention relates to a stainless cast alloy steel for use at low temperatures.

More particularly, the present invention provides a stainless cast alloy steel for use at low temperatures as a casting material for use in fabricating apparatus for use in a LNG (Liquid Natural Gas) plant or the like to be used under a low temperature atmosphere (from room temperature to 0° K.), for example, valves, pumps, compressor bodies, bonnets, casings or the like, particularly portions that deform by martensitic transformation which must be avoided during production or use, e.g., ground joint portions, airtight portions, sliding portions or the like.

2. Description of the Prior Art

Heretofor, ASTM CF 8 (18 Cr-8Ni) has been mainly used as the stainless cast alloy steel for low temperature environments. However, this material has the defect that, when exposed to low temperature atmosphere, a volume change due to martensitic transformation occurs in a short period of time, whereby the material deforms, and, as a result, deformation sometimes leads to cracking and leakage of explosive vapors. In order to prevent such deformation, various attempts have been made, e.g.: (1) the upper value of the nickel content of the standardized range of CF 8 is used instead of the lower value (actually, more than 9.5–10% by weight); (2) sub-zero treatment (immersion in liquid nitrogen at − 196° C. for 0.5 to 1.5 hrs) is conducted several times; (3) expensive CF 8M (18 Cr-12 Ni-2Mo) is used and so on. However, these solutions do not provide a satisfactory result, rather, they increase the cost of products formed therefrom.

Further, as a two-phase alloy containing ferrite, several stainless alloy steels have been developed for the purpose of improving resistance to stress, corrosion cracking or the like as disclosed in Japanese Pat. No. 602,636 and French Pat. No. 1,422,764, but these are stainless alloy steels as opposed to stainless cast alloy steels of the present invention, and generally crystallize a ferrite phase in an amount of at least about 40% by volume (in the structure of the steel).

SUMMARY OF THE INVENTION

The primary object of the present invention is to eliminate the above defects due to a martensitic transformation in conventional stainless cast alloy steels and to provide a new stainless cast alloy steel suitable for use at low temperatures.

The present invention provides a stainless cast alloy steel for use at a low temperature comprising: from about 0.03 to about 0.15% by weight of C; up to about 2% by weight of Si; up to about 2% by weight of Mn; from about 18 to about 26% by weight of Cr; from about 5 to about 13% by weight of Ni; the remainder being Fe and unavoidable trace impurities; wherein from about 10 to about 40% by volume, based on the volume of the cast alloy steel, constitutes a ferrite phase.

DETAILED DESCRIPTION OF THE INVENTION

Figure 1:
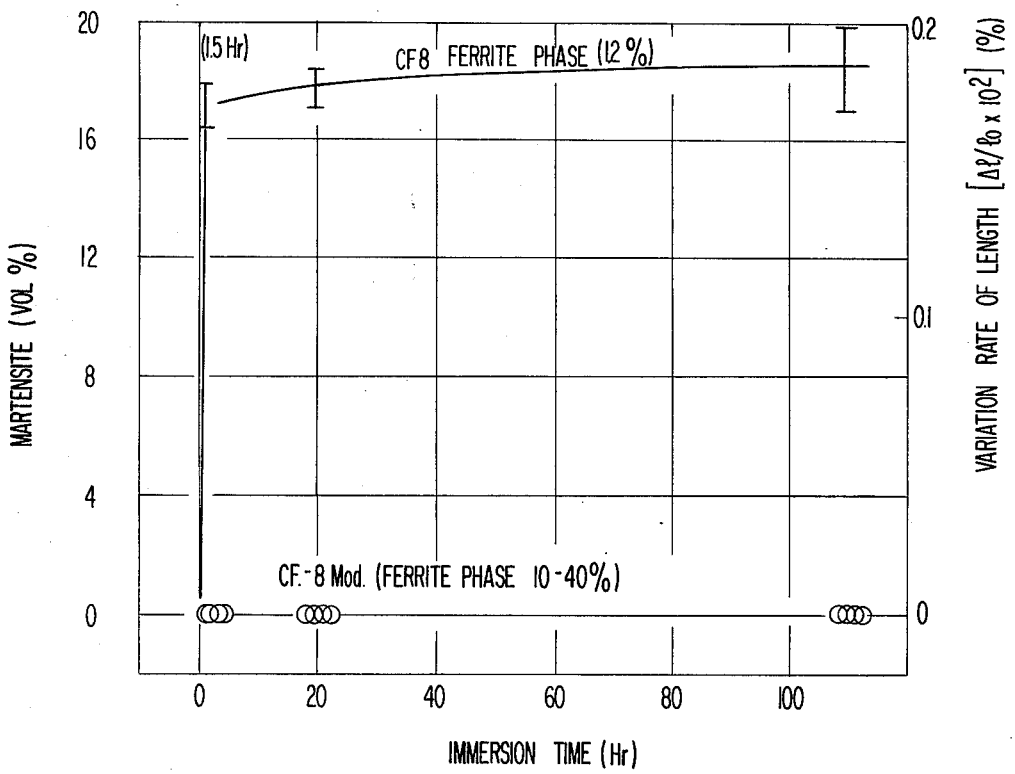
FIG. 1 shows the amount of martensite in a cast alloy steel according to the present invention and CF 8 and the deformation rate thereof in liquid nitrogen (−196° C.) with increasing time.
Figure 2:
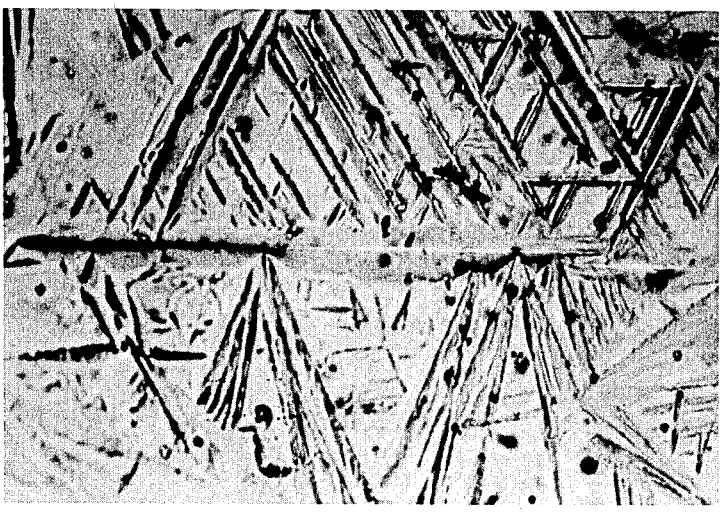
FIG. 2 is a microscopic photograph (magnification: × 480) showing the deformation structure due to the martensitic transformation of ASTM CF 8 (18 Cr-8 Ni).

The most important characteristic feature of the present invention resides in crystallizing a ferrite phase which is about 10 to about 40% by volume of the volume of the cast alloy steel of the present invention whereby various satisfactory properties can be obtained for low temperature use, most typically at from room temperature to 0° K., and even more especially at from −20° to −273° C.

Table 1 shows experimental results of the castability using trial valves manufactured for the experimentation.

Table 1

| Amount of Ferrite (Vol. %) | Composition (wt %) C | Cr | Ni | Casting Defects |
|---|---|---|---|---|
| 0 – 10 | 0.06 | 18.40 | 8.40 | Many casting defects (blow holes, shrinkage, etc.) |
| | 0.15 | 19.05 | 8.20 | Internal cracks |
| 10 – 15 | 0.02 | 18.85 | 8.03 | Some casting defects |
| 15 – 20 | 0.07 | 20.15 | 6.78 | No casting defects |
| 20 – 30 | 0.07 | 20.55 | 6.33 | No casting defects |
| | 0.15 | 21.05 | 8.00 | |
| 30 – 40 | 0.07 | 26.00 | 7.51 | No casting defects |
| | 0.15 | 24.40 | 10.00 | |
| above 40 | 0.06 | 25.53 | 5.20 | Casting defects and internal cracks occur |

As can be seen from the data in Table 1, if the amount of ferrite is less than about 10% by volume, many casting defects are encountered such as blow holes, shrinkage or the like, and internal cracks occur, while if the amount exceeds about 40% by volume, similar defects are involved.

On the other hand, in the case of crystallizing a ferrite phase comprising about 10 to about 40%, preferably 15 to 30%, by volume of the structure, no problems occur upon casting. Table 1 further establishes that even if the volume of the ferrite phase falls within the above-mentioned range, if the C content is less than about 0.03% by weight, casting defects slightly appear. Therefore, the amount of a ferrite phase crystallized should be about 10 to abou 40%, preferably about 15 to about 30%, by volume based on the volume of the cast alloy steel.

Carbon serves to lower the Ms point, and considering product processability, e.g., castability and the like, it is necessary to use carbon in an amount of from about 0.03 to 0.15% by weight. The limitation on the carbon content range has a close relationship with the amount of a ferrite phase, and, according to the present invention, the above-mentioned range is effective to prevent low temperature brittleness of the steel.

Silicon is necessary for the formation of the ferrite phase and serves as a deoxidant. Silicon is used in an amount of up to about 2% by weight, and if the amount exceeds about 2% by weight, brittleness is increased and weldability is lowered.

Manganese is used in an amount of up to about 2% by weight. If the amount of exceeds about 2%, anti-oxidation, impact resistance and castability lower.

It is to be noted that the minimum content of Si and Mn is O, i.e., they can be omitted from the stainless cast alloy steel of the present invention if desired, and no problems are encountered with respect to casting.

A ferrite phase having a high chromium content causes 475° C. embrittlement or sigma phase embrittlement when the material of the present invention is heated above about 400° C. for a long period of time at welding or heat treatment. Therefore, it is better to avoid using a large amount of chromium. However, if the amount is less than about 18% by weight, a martensitic structure is formed during the cooling stage of the casting process. Therefore, the amount of chromium is from about 18 to about 26% by weight.

The amount of nickel has a close relationship with the amount of the ferrite phase formed, that is, if the amount is too large, the amount of the ferrite phase becomes less, while, on the contrary, if it is too small, an $\gamma$ - $\alpha'$ transformation occurs. In view of the above, the amount of nickel is in an amount of from about 5 to about 13% by weight. Further, in order to suppress the $\gamma$ - $\alpha'$ transformation completely, about 7 to about 13% by weight of nickel is preferred. In connection with this, reference is made to Table 2 which shows the relationship between the nickel content in a stainless cast alloy steel for use at low temperatures and the nickel content in the austenitic phase thereof.

Table 2

| Amount of Ferrite (Vol. %) | Ni Content (wt. %) | | |
|---|---|---|---|
| | (1) | (2) | (2)/(1) |
| 1.2 | 8.4 | 8.6 | 1.02 |
| 7.5 | 8.0 | 8.7 | 1.09 |
| 10.0 | 8.2 | 9.0 | 1.10 |
| 21.5 | 5.9 | 7.2 | 1.22 |
| 25.7 | 8.0 | 10.0 | 1.25 |
| 29.5 | 8.2 | 10.3 | 1.26 |
| 40.0 | 10.0 | 12.8 | 1.28 |
| 42.0 | 5.2 | 7.0 | 1.35 |

Notes
(1)Average Ni content in the steel
(2)Ni content in the austenitic phase

As can be seen from the above, by crystallizing a ferrite phase of from about 10 to about 40% by volume of the casting structure, the average amount of nickel in the austenitic phase thereof is 1.2 to 1.3 times larger than that in the cast alloy steel. That is, where the average amount of nickel in the cast alloy steel is 8% by weight, the nickel content in the austenitic phase is 10.0% by weight. Therefore, an $\gamma$ - $\alpha'$ transformation can be suppressed by the addition of a small amount of nickel, and, as a result, deformation can be prevented and castability is extremely good. Further, by the crystallization of a ferrite phase in an amount of about 10 to about 40% by volume, grains of austenitic crystals present are finely divided, and, consequently the $\gamma$ - $\alpha'$ transformation can be suppressed, and even if a large amount of ferrite is crystallized, no brittleness at low tempreatures occurs since nickel is present as a solid solution.

The balance of the product of the present invention is iron and unavoidable trace impurities. The amount of iron varies widely depending upon the amount of other components but iron is generally used in an amount of from about 56 to about 75% by weight. Further, it is preferred to suppress the amount of unavoidable trace impurities in the cast alloy steel to an extent of up to about 1.0% by weight of most.

Thus, the present invention comprises blending specific amounts of carbon, silicon, manganese, chromium and nickel, the remainder being iron and unavoidable impurities, so as to crystallize a ferrite phase which is from about 10 to about 40% by volume of the cast alloy steel structure. Further, for purposes of stabilizing the ferrite phase, it is preferred to carry out a solution treatment after casting at temperatures between about 1,000° and about 1,200° C. for about 1 hour or more to insure formation of a solid solution.

The characteristics of the stainless cast alloy steel for use at low temperatures according to the present invention will now be explained in more detail:

(1) Even if used at extremely low temperatures for long periods of time, no deformation due to a martensitic transformation occurs, and toughness at low temperatures is excellent as compared with that of conventional CF 8.

(2) It is possible to reduce the amount of nickel as compared with conventional stainless cast alloy steels for use at low temperatures (minimum nickel content: 9.5% by weight).

(3) Sub-zero treatment at production is not necessary.

(4) Since the cast alloy steel of the present invention is excellent in castability as compared with conventional CF8, small sized valves which are prepared at present by forging can be formed by casting, and, also, the cast alloy steel of the present invention is suitable as a material for the fabrication of valves, pumps, compressor bodies, bonnets, casings, or the like, most especially for components where martensitic deformation must be avoided during production or use, e.g., at ground joint portions, airtight portions, sliding portions and the like.

Figure 3:
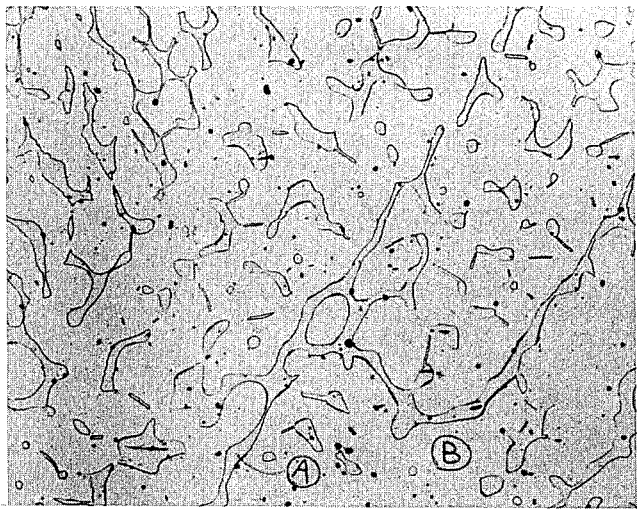
FIG. 3 is a microscopic photograph (magnification: × 100) showing the structure of a cast alloy steel according to the present invention after a sub-zero treatment ( − 196° C. × 110 hrs.).

Referring to the drawings, FIG. 1 shows that conventional CF8 (Ni content: 8.0 to 9.5 wt. %, ferrite content: not more than 5% by volume) undergoes a martensitic transformation in a relatively short period of time, whereas the cast alloy steel of the present invention containing not less than 0.03 wt.% of carbon and not less than 10% by volume of a ferrite phase does not undergo a martensitic transformation if the amount of ferrite phase is large, even if the amount of nickel is as low as 5.0 wt.%. This is apparent from FIG. 3, wherein A indicates a ferrite phase and B indicates an austenitic phase.

As one skilled in the art will appreciate, the ferrite phase of the stainless cast alloy steel of the present invention is formed by blending, in suitable proportions as shown in the Examples, elements (e.g., Cr, Si, Fe and unavoidable impurities) which form the ferrite phase and elements (e.g., C, Ni, Mn, Fe and unavoidable impurities) which form the austenitic phase, and subsequent thereto dissolving the elements.

The present invention will now be illustrated more specifically by reference to the following examples, but the present invention is not to be construed as being limited to these examples.

EXAMPLE 1

Various cast alloy steels were subjected to a low-temperature treatment (−196° C. × 100 hrs.).

The results obtained are shown in Table 3 below.

Table 3

| Run No. | Amount of Ferrite(Wt.%) | Chemical Composition*(wt.%) C | Si | Mn | Ni | Cr | −196° C × 100 hrs Test Results |
|---|---|---|---|---|---|---|---|
| 1 | 17.0 | 0.02 | 1.05 | 1.23 | 5.84 | 18.83 | Martensitic transformation occurred in 1.5 hrs. |
| 2 | 23.5 | 0.03 | 1.09 | 0.88 | 9.25 | 22.17 | No transformation |
| 3 | 18.0 | 0.05 | 1.21 | 0.98 | 8.40 | 20.63 | No transformation |
| 4 | 1.2 | 0.06 | 1.39 | 1.70 | 8.40 | 18.40 | " |
| 5 | 13.0 | 0.06 | 1.34 | 0.91 | 8.20 | 20.65 | No transformation |
| 6 | 22.0 | 0.06 | 1.22 | 1.06 | 8.40 | 20.96 | " |
| 7 | 24.0 | 0.07 | 1.40 | 1.61 | 6.33 | 20.55 | No transformation |
| 8 | 37.0 | 0.07 | 1.53 | 1.54 | 7.51 | 26.00 | " |
| A-1 | 3.0 | 0.15 | 1.69 | 1.26 | 8.20 | 19.05 | Martensitic transformation occurred in 10 hrs. |
| A-2 | 14.0 | 0.15 | 1.34 | 1.35 | 5.90 | 18.20 | No transformation |
| A-3 | 21.0 | 0.15 | 1.66 | 1.32 | 8.00 | 21.05 | " |
| A-4 | 35.5 | 0.15 | 1.13 | 1.92 | 10.00 | 24.40 | " |

Note
*Phosphorus content: not more than 0.040 wt. %
Sulfur content: not more than 0.030 wt. %

It will be apparent from the above data that if the amount of ferrite is less than about 10% by volume, a martensitic transformation occurs within 1.5 hrs in a sub-zero treatment of − 196° C. × 100 hrs, and that if the amount of carbon is less than about 0.03% by weight, the martensitic transformation occurs in a treatment time of 1.5 hrs.

It will also be apparent from the above data (from Run Nos. A-1 to A-4 where the amount of the ferrite phase is varied while maintaining the amount of carbon constant) that if the amount of ferrite is less than about 10% by volume, martensitic transformation occurs.

EXAMPLE 2

The stainless cast alloy steels of the present invention were treated in the following manner to measure the Charpy impact value at − 196° C:

Manner (1): Solid solution treatment; heating at 1,100° C. for 3 hours, cooling to room temperature by quenching in water, and then cooling to − 196° C. and thereafter measuring the Charpy impact value.

Manner (2): Solid solution treatment; heating at 1,100° C. for 3 hours, cooling to room temperature by quenching in water, and then heat-treating at 450° C. for 2 hours, again cooling to room temperature by quenching in water, and then cooling to − 196° C. and measuring the Charpy impact value.

Manner (3): Solid solution treatment; heating at 1,100° C. for 3 hours, cooling to normal temperature by quenching in water, and then cooling to − 196° C., and maintaining for 100 hours at the same temperature and measuring the Charpy impact value.

For the sake of comparison, conventional CF8 was treated in the same manner as in Manner (1) above except that the solution treatment time was 1 hour.

The results obtained are shown in Table 4.

Table 4

| | Treatment Manner | Charpy Impact Value (kg.m) Experimental Value | Average Value |
|---|---|---|---|
| Cast Alloy Steel of this Invention (Amount of Ferrite: 10 to 40 Vol. %) | (1) | 16.6 – 19.4 | 18.0 |
| | (2) | 11.8 – 16.0 | 13.9 |
| | (3) | 14.8 – 19.8 | 17.3 |
| CF 8 | Same as (1) but treatment time was 1 hr. | 4.0 – 13.0 | 8.5 |

As will be apparent from the above data, the cast alloy steel of the present invention is far superior to conventional CF8 in toughness at low temperatures (−196° C.).

While the invention has been described in detail and with reference to specific embodiments thereof, it well be apparent to one skilled in the art that various changes and modifications can be made therein without departing from the spirit and scope thereof.

What is claimed is:

1. A stainless cast alloy steel for use at from room temperature to 0° K. consisting essentially of about 0.03 to about 0.15% by weight of C., up to about 2% by weight of Si, up to about 2% by weight of Mn, about 18 to about 26% by weight of Cr, about 5 to about 13% by weight of Ni, and the remainder of Fe and unavoidable impurities, wherein about 20 to about 40% by volume based on the volume of said steel constitutes a ferrite phase.

2. The stainless cast alloy steel as claimed in claim 1, wherein the amount of the said ferrite phase is from about 20 to about 30% by volume.

3. The stainless cast alloy steel as claimed in claim 1, wherein the amount of Ni is from about 7 to about 13% by weight.

4. A fabricated article of manufacture formed of the stainless cast alloy steel of claim 1 for use at from room temperature to 0° K.

* * * * *